US009420654B2

(12) United States Patent
Lee et al.

(10) Patent No.: US 9,420,654 B2
(45) Date of Patent: Aug. 16, 2016

(54) FEEDBACK CONTROL CIRCUIT AND LED DRIVING CIRCUIT

(71) Applicant: GREEN SOLUTION TECHNOLOGY CO., LTD., New Taipei (TW)

(72) Inventors: Li-Min Lee, New Taipei (TW); Shian-Sung Shiu, New Taipei (TW); Chih-Chun Sung, Wuxi (CN)

(73) Assignee: GREEN SOLUTION TECHNOLOGY CO., LTD., New Taipei (TW)

( * ) Notice: Subject to any disclaimer, the term of this patent is extended or adjusted under 35 U.S.C. 154(b) by 338 days.

(21) Appl. No.: 13/975,388

(22) Filed: Aug. 26, 2013

(65) Prior Publication Data

US 2014/0333217 A1 Nov. 13, 2014

(30) Foreign Application Priority Data

May 13, 2013 (CN) ..... 2013 1 0174923

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/0845* (2013.01); *H05B 33/0827* (2013.01)

(58) Field of Classification Search

CPC ..... H05B 33/0815; H05B 41/3927; H05B 41/28; H05B 41/3921; H05B 41/2828

USPC ..... 315/307, 291, 187

See application file for complete search history.

(56) References Cited

U.S. PATENT DOCUMENTS

| | | | | |
|---|---|---|---|---|
| 6,285,139 | B1 * | 9/2001 | Ghanem | 315/291 |
| 8,098,027 | B2 * | 1/2012 | Tsai et al. | 315/307 |
| 2011/0109231 | A1 | 5/2011 | Shiu et al. | |

(Continued)

FOREIGN PATENT DOCUMENTS

| | | |
|---|---|---|
| CN | 102271442 | 12/2011 |
| CN | 102595702 | 7/2012 |
| TW | 201143502 | 12/2011 |

OTHER PUBLICATIONS

"Office Action of Taiwan Counterpart Application", issued on Apr. 17, 2015, p. 1-p. 7, in which the listed reference was cited.

(Continued)

*Primary Examiner* — Quan Tra

(74) *Attorney, Agent, or Firm* — Jianq Chyun IP Office

(57) ABSTRACT

A feedback control circuit, adapted to control a converting circuit to transform an input power into an output voltage for driving an LED module. The feedback control circuit comprises a detection circuit, a PWM circuit, a PWM logic control circuit and a PWM control circuit. The detection circuit is coupled to at least one LED string of the LED module and generates at least one detection signal. The PWM circuit comprises a capacitance, a charging circuit and a discharging circuit, and determines a capacitance voltage of the capacitance to increase, decrease, or maintain. The PWM logic control circuit compares a level of the least one detection signal with a high reference level and a low reference level to control the PWM circuit to adjust the capacitance voltage. The PWM control circuit controls the converting circuit to execute the power transformation in response to the capacitance voltage of the capacitance.

10 Claims, 7 Drawing Sheets

(56) References Cited

U.S. PATENT DOCUMENTS

| | | | | |
|---|---|---|---|---|
| 2011/0291575 | A1* | 12/2011 | Shiu et al. | 315/192 |
| 2011/0291591 | A1* | 12/2011 | Shiu et al. | 315/297 |
| 2012/0013267 | A1 | 1/2012 | Yoshio et al. | |
| 2012/0176048 | A1* | 7/2012 | Li et al. | 315/186 |

OTHER PUBLICATIONS

"Office Action of China Counterpart Application" , issued on Nov. 10, 2015, p. 1-p. 6, in which the listed references were cited.

* cited by examiner

FEEDBACK CONTROL CIRCUIT AND LED DRIVING CIRCUIT

CROSS-REFERENCE TO RELATED APPLICATION

This application claims the priority benefit of China patent application serial no. 201310174923.4, filed on May 13, 2013. The entirety of the above-mentioned patent application is hereby incorporated by reference herein and made a part of the specification.

BACKGROUND OF THE INVENTION (1) Field of the Invention

The present invention relates to a feedback control circuit and LED driving circuit.

(2) Description of the Prior Art

In general, the driving methods for LED can be classified into a constant voltage driving and a constant current driving. Due to the characteristics of the LED, the constant current driving method can optimize the luminous efficiency of LED, and it is the most popular method of driving LED. The common constant current driving method uses an error amplifier to adjust a driving voltage of an LED string through detecting a negative end voltage of the LED string.

FIG. 1 is a schematic diagram of a conventional an LED driving circuit with constant current controlling. The LED driving circuit comprises a boost converter circuit, a control circuit 10 and a current control circuit ILC for driving an LED module LD. The boost converter circuit comprises an inductance L, a capacitance C, a diode D and a transistor M. One end of the inductance L is coupled to an input voltage Vin and the other end thereof is coupled to a positive end of the diode D. A negative end of the diode D is coupled to the capacitance C to provide an output voltage Vout for driving the LED module LD. The transistor M is coupled to a connected point of the diode D and the inductance L, and is switched according to a control signal Sdrv to make an electric power from the input voltage Vin be stored in the inductance L and the capacitance C. A positive end of the LED module LD is coupled to the output voltage Vout, and the negative end thereof is coupled to the current control circuit ILC. The current control circuit ILC controls the current flowing through the LED module LD at a predetermined current value steadily.

The control circuit 10 comprises an error amplifier 1, a compensation circuit 2, a PWM comparator 3, a logic circuit 4 and a driver circuit 5. An inverting input end of the error amplifier 1 is coupled to a negative end of the LED module L for receiving a detection signal IFB, and a non-inverting input end thereof receives a reference level Vr. An output end of the error amplifier 1 is coupled to the compensation circuit 2 and generates an error compensated signal Scomp at the compensation circuit 2 according to the detection signal IFB and the reference level Vr. A non-inverting input end of the PWM comparator 3 receives the error compensated signal Scomp, and an inverting input end thereof receives a ramp signal and accordingly generates a PWM signal Spwm. The logic circuit 4 receives the PWM signal Spwm and accordingly generates a PWM control signal Sct. The driver circuit 5 receives the PWM control signal Sct and accordingly generates the control signal Sdrv to control the duty cycle of the transistor M for adjusting the output voltage Vout.

FIG. 2 is a schematic diagram of another conventional LED driving circuit, adapted to drive the plural of the LED strings of the backlight module of the LCD monitor lighting. The currents of the plural of the LED strings L1~LN are respectively controlled by current sources CS1~CSN. A backlight control circuit 20 comprises a minimum voltage selection circuit 21, which is adapted to choose the minimum voltage among negative ends of all LED strings L1~LN, and transmit a minimum voltage signal to an error amplifier 13. The error amplifier 13 controls a voltage supply circuit 11 according to the minimum voltage signal and a reference level Vr, and transforms an input voltage Vin into an output voltage Vout.

These control loop methods for driving LED require complicated loop compensation, which increases the difficulty in design.

SUMMARY OF THE INVENTION

For solving the aforementioned disadvantages of the prior art, the present invention provides a feedback control circuit and LED driving circuit to avoid a complicated pole-zero compensation and simultaneously achieves the high luminous efficiency of LED.

To accomplish the aforementioned and other objects, the present invention provides a feedback control circuit, adapted to control a converting circuit to execute a power transformation for driving an LED module, and the LED module has at least one LED string connected in parallel. The feedback control circuit comprises a detection circuit, a PWM circuit, a PWM logic control circuit and a PWM control circuit. The detection circuit is coupled to the least one LED string of the LED module and generates at least one detection signal is response to a state of the least one LED string. The PWM circuit comprises a capacitance, a charging circuit and a discharging circuit, and the charging circuit and the discharging circuit determine a capacitance voltage of the capacitance to increase, decrease or maintain according to a set of control signals. The PWM logic control circuit generates the set of the control signals in response to the compared results of a level of at least one detection signal with a high reference level and a low reference level, wherein the high reference level is higher than the low reference level. The PWM control circuit controls the converting circuit to execute the power transformation in response to the capacitance voltage of the capacitance.

The present invention also provides an LED driving circuit, adapted to drive a plural of the LED strings connected in parallel. The LED driving circuit comprises a converting circuit, a plural of the current control circuits and a feedback control circuit. The converting circuit, adapted to execute a power transformation for driving the plural of the LED strings. Each of the current control circuit has a current control end, coupled to the corresponding LED string of the plural of the LED strings for flowing through a corresponding LED string a predetermined current value. The feedback control circuit comprises a minimum voltage detection circuit, a PWM circuit, a PWM logic control circuit and a PWM control circuit. The minimum voltage detection circuit is coupled to the current control ends and generates a detection signal according to a minimum voltage among the current control ends. The PWM circuit comprises a capacitance, a charging circuit and a discharging circuit. The charging circuit and the discharging circuit determine a capacitance voltage of the capacitance to increase, decrease or maintain according to a set of control signals. The PWM logic control circuit generates the set of the control signals in responses to compared results of a level of the detection signal with a high reference level and a low reference level. The high reference level is higher than the low reference level. The PWM control circuit controls the converting circuit to execute the power transformation in response to the capacitance voltage of the capacitance.

It is to be understood that both the foregoing general description and the following detailed description are exemplary, and are intended to provide further explanation of the invention as claimed. In order to make the features and the advantages of the invention comprehensible, exemplary embodiments accompanied with figures are described in detail below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
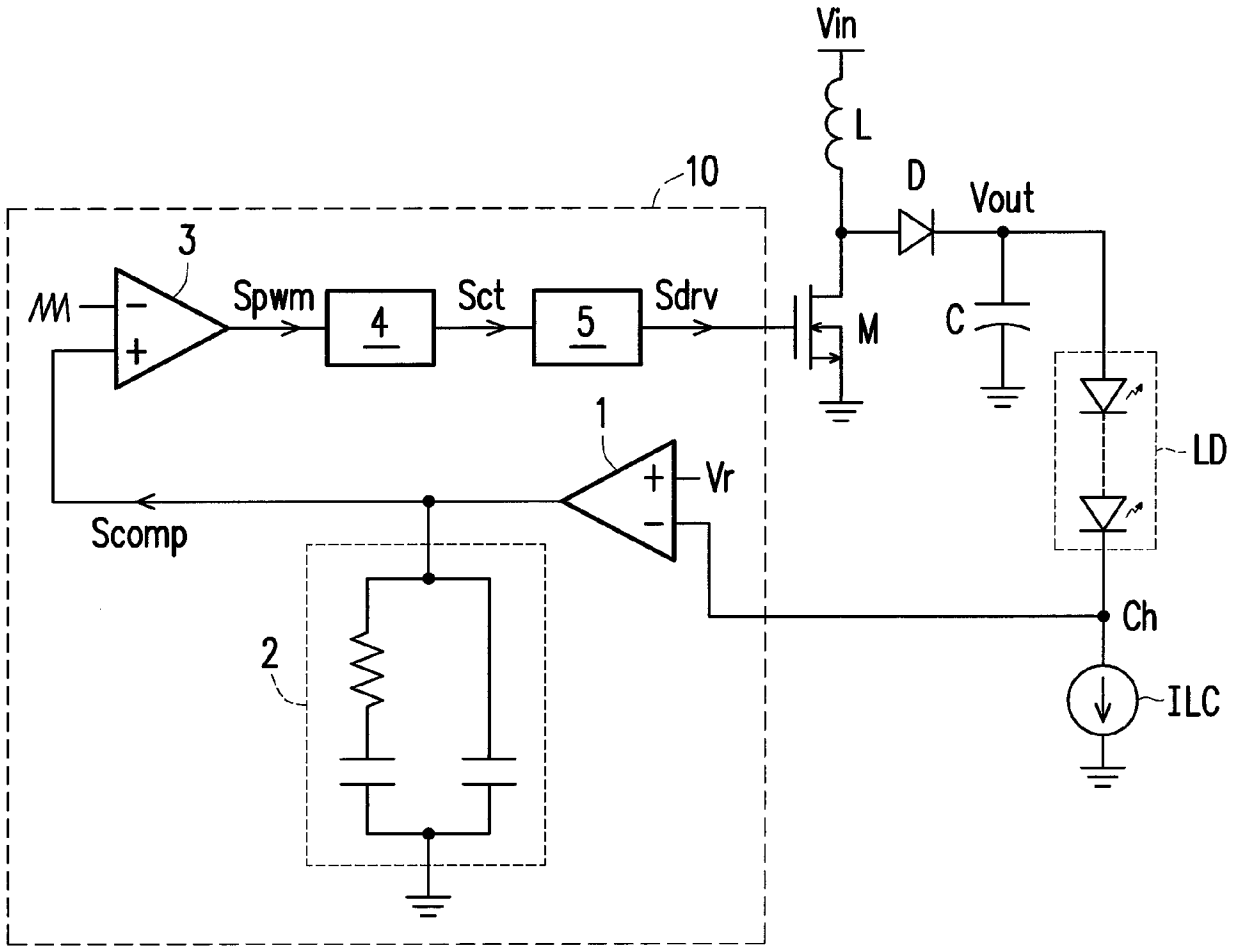
FIG. 1 (PRIOR ART)
FIG. 1 is a schematic diagram of a conventional an LED driving circuit with constant current controlling.
Figure 2:
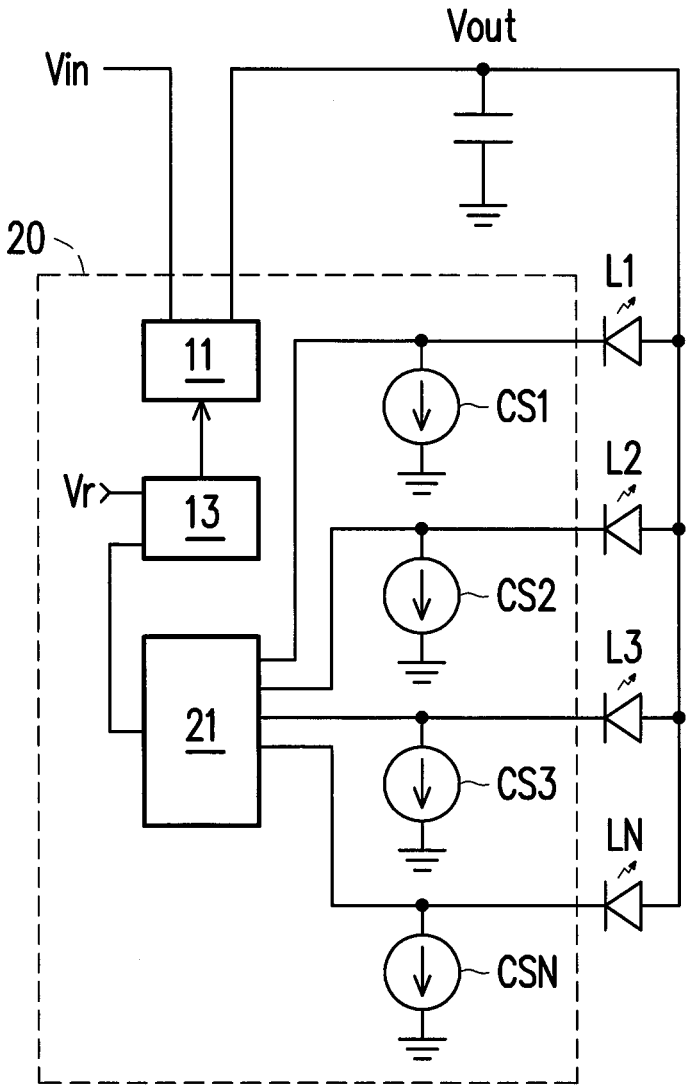
FIG. 2 (PRIOR ART)
FIG. 2 is a schematic diagram of another conventional LED driving circuit.
Figure 3:
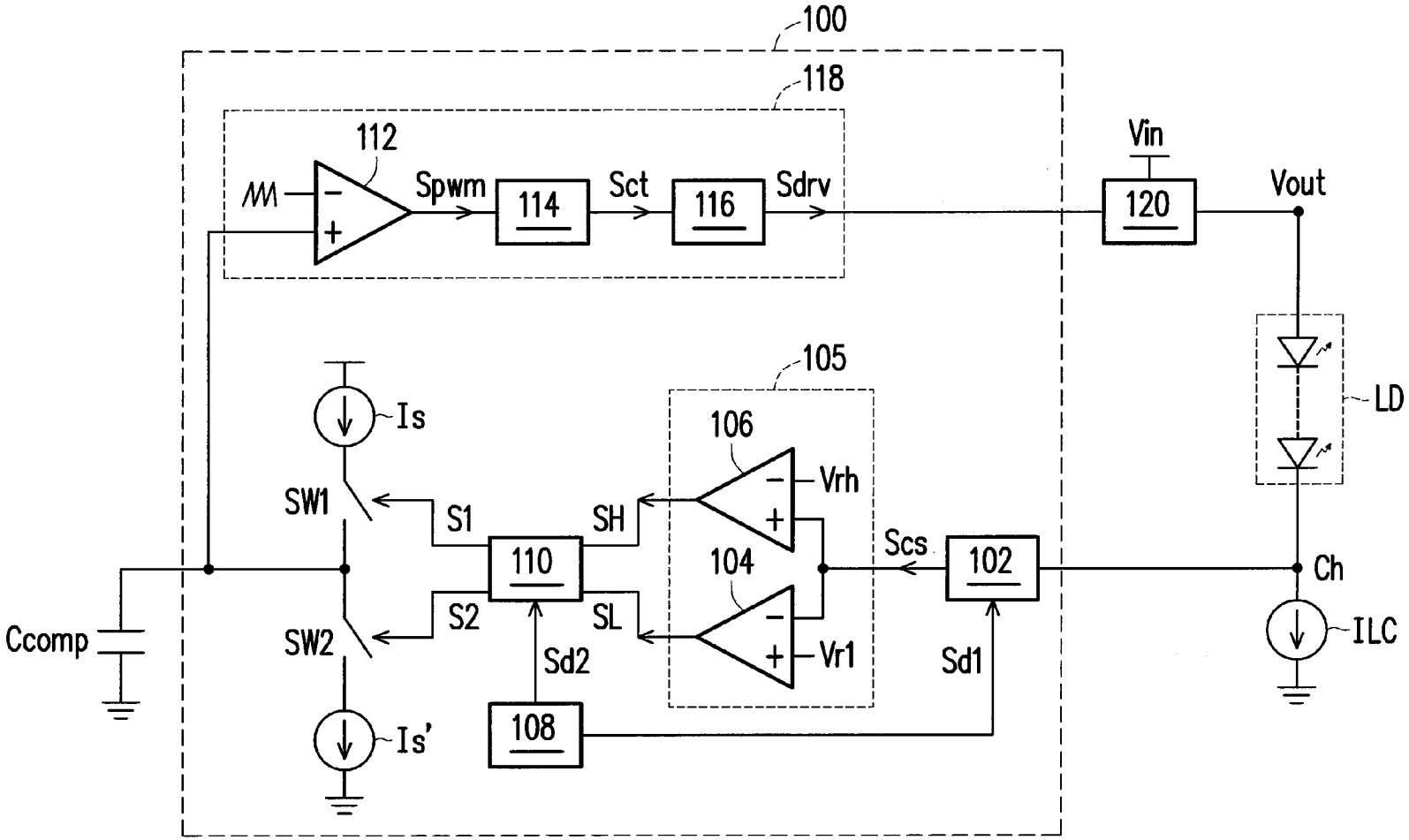
FIG. 3 is a schematic diagram of an LED driving circuit according to a first preferred embodiment of the present invention.

FIG. 3 is a schematic diagram of an LED driving circuit according to a first preferred embodiment of the present invention. The LED driving circuit, adapted to drive a LED module LD which comprises an LED string, comprises a converting circuit 120, a current control circuit ILC and a feedback control circuit 100. The converting circuit 120 is coupled to an input voltage Vin, and transforms an electric power from the input voltage Vin into an output voltage Vout to drive the LED string of the LED module lighting. The current control circuit ILC has a current control end Ch coupled to the LED module LD for controlling the LED string flowing through a predetermined current value.

The feedback control circuit 100 comprises a detection circuit 102, a PWM circuit, a PWM logic control circuit and a PWM control circuit 118. The detection circuit 102 is coupled to the LED module LD. In the present embodiment, the detection circuit 102 is coupled to the current control end Ch for generating a detection signal Scs in response to a voltage or a current of the LED string. The PWM logic control circuit comprises a comparison circuit 105, which compares a level of the detection signal Scs with a high reference level Vrh and a low reference level Vrl, and accordingly generates a high compared result signal SH and a low compared result signal SL. The high reference level Vrh is higher than the low reference level Vrl. The comparison circuit 105 comprises comparators 104 and 106. A non-inverting input end of the comparator 104 receives the low reference level Vrl, and an inverting input end thereof receives the detection signal Scs, and accordingly generates the low compared result signal SL. When the level of the detection signal Scs is lower than the low reference level Vrl, the low compared result signal SL is at a high level. On the other hand, when the level of the detection signal Scs is higher than the low reference level Vrl, the low compared result signal SL is at a low level. A non-inverting input end of the comparator 106 receives the detection signal Scs, and an inverting input end thereof receives the high reference level Vrh, and accordingly generates the high compared result signal SH. When the level of the detection signal Scs is lower than the high reference level Vrh, the high compared result signal SH is at a low level. On the other hand, when the level of the detection signal Scs is higher than the high reference level Vrh, the high compared result signal SH is at a high level. The PWM logic control circuit further comprises a compared result logic circuit 110 and generates a set of control signals S1 and S2 to control the PWM circuit according to the compared result of the comparison circuit 105, i.e., the high compared result signal SH and the low compared result signal SL.

The PWM circuit comprises a capacitance Ccomp, a charging circuit Is and a discharging circuit Is'. The charging circuit Is is coupled to the capacitance Ccomp through a charging switch SW1, and the discharging circuit Is' is coupled to the capacitance Ccomp through a discharging switch SW2. When the level of the detection signal Scs is between the high reference level Vrh and the low reference level Vrl, the compared result logic circuit 110 stops to generate the control signals S1 and S2 (i.e., the charging circuit Is and the discharging circuit Is' respectively stop charging and discharging to the capacitance Ccomp). At this moment, a capacitance voltage of the capacitance Ccomp is maintained. When the level of the detection signal Scs is lower than the low reference level Vrl, the compared result logic circuit 110 generates the control signal S1 to turn the charging switch SW1 on, while turning the discharging switch SW2 off. At this moment, the charging circuit Is charges the capacitance Ccomp to increase the capacitance voltage. When the level of the detection signal Scs is higher than the high reference level Vrh, the compared result logic circuit 110 generates the control signal S2 to turn the discharging switch SW2 on, while turning the charging switch SW1 off. At this moment, the discharging circuit Is' discharges the capacitance Ccomp to decrease the capacitance voltage.

In the embodiment of the present invention, a dimming control circuit 108 is additionally increased. The dimming control circuit 108 receives an external dimming signal PWM and generates a first dimming signal Sd1 to the detection circuit 102, or/and a second dimming signal Sd2 to the compared result logic circuit 110. The dimming signal PWM is used to control the PWM control circuit 118 of the feedback control circuit 100 or the current control circuit ILC to make the LED module LD periodically light and stop lighting for achieving the dimming function. However, the LED module LD periodically lights and stops lighting to make the voltage or the current of the LED module LD periodically vary. Therefore, a voltage of the current control end Ch also periodically varies when the LED module LD is driven to light, and moreover the voltage variations are different when the dimming signal PWM is used to control the PWM control circuit 118 and when the dimming signal PWM is used to control the current control circuit ILC. Such voltage variation would make the feedback control circuit 100 imprecisely control, and even erroneously operate. The dimming control circuit 108 separately controls the detection circuit 102 or/and the PWM logic control circuit in response to the dimming signal PWM to avoid the problems mentioned above.

The PWM control circuit 118 comprises a PWM comparator 112, a logic circuit 114 and a driver circuit 16. A non-inverting input end of the PWM comparator 112 receives the capacitance voltage of the capacitance Ccomp, an inverting input end thereof receives a ramp signal, and accordingly generates a PWM signal Spwm. The logic circuit 114 receives the PWM signal Spwm and accordingly generates a PWM control signal Sct. The driver circuit 116 receives the PWM control signal Set and accordingly generates a control signal Sdrv to control the converting circuit 120 for adjusting the output voltage Vout. When the capacitance voltage of the capacitance Ccomp increases, the duty cycle of the control signal Sdrv increases to raise the output voltage Vout. When the capacitance voltage of the capacitance Ccomp decreases, the duty cycle of the control signal Sdrv reduces to decrease the output voltage Vout. When the capacitance voltage of the capacitance Ccomp is maintained, the duty cycle of the control signal Sdrv is also maintained to make the changes of the output voltage Vout be relatively slow.

Figure 4:
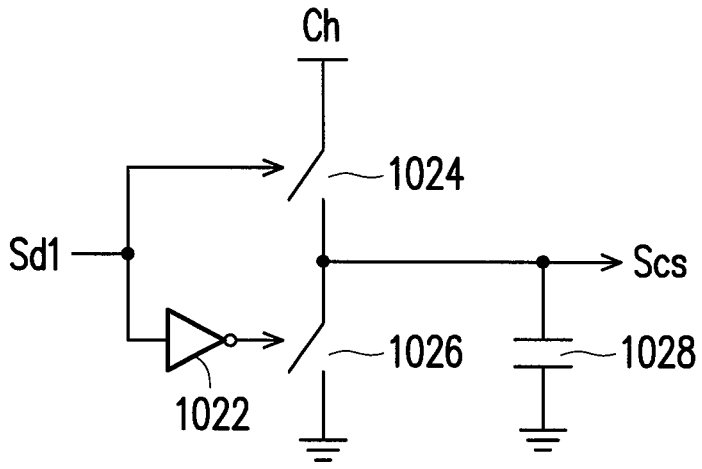
FIG. 4 is a schematic diagram of a detection circuit according to a preferred embodiment of the present invention.

FIG. 4 is a schematic diagram of a detection circuit according to a preferred embodiment of the present invention. The detection circuit comprises an inverter 1022, switches 1024 and 1026 and a detection capacitance 1028. The detection circuit receives a first dimming signal Sd1 generated by the dimming control circuit 108 of the aforementioned embodiment. The switch 1024 is coupled to the current control end Ch and the detection capacitance 1028, and the switch 1026 is coupled to the detection capacitance 1028 and a common potential, herein the grounding. The inverter 1022 inverses the first dimming signal Sd1 to make the switch 1024 and the switch 1026 not to be turned on simultaneously. When the dimming signal PWM represents that the LED module lights, the first dimming signal Sd1 is at a high level to turn the switch 1024 on while the switch 1026 is turn-off. At this moment, the detection circuit samples a voltage of the current control end Ch by the detection capacitance 1028. When the dimming signal PWM represents that the LED module stops lighting, the first dimming signal Sd1 is at a low level to turn the switch 1024 off while the switch 1026 is turn-on. The sampled voltage of the detection capacitance 1028 is reset to be zero through the switch 1026. By the control method mentioned above, the detection circuit operates between sampling state and non-sampling state in response to the dimming signal PWM.

Figure 5:
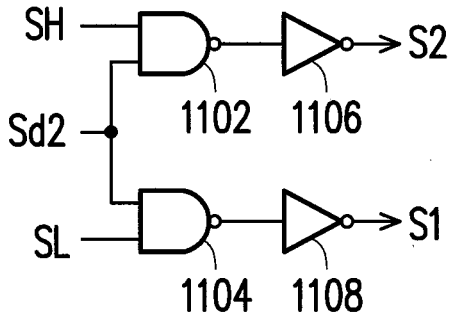
FIG. 5 is a schematic diagram of a compared result logic circuit according to a first preferred embodiment of the present invention.

FIG. 5 is a schematic diagram of a compared result logic circuit according to a first preferred embodiment of the present invention. The compared result logic circuit comprises NAND gates 1102 and 1104 and inverters 1106 and 1108. The NAND gate 1102 receives the high compared result signal SH generated by the comparator 106 and the second dimming signal Sd2 generated by the dimming control circuit 108. The NAND gate 1104 receives the low compared result signal SL generated by the comparator 104 and the second dimming signal Sd2 generated by the dimming control circuit 108.

When the dimming signal PWM represents that the LED module lights, the second dimming signal Sd2 is at a high level. If the detection signal Scs is higher than the high reference level Vrh, the high compared result signal SH is at the high level and the low compared result signal SL is at the low level. Thus, the control signal S1 is at a low level and the control signal S2 is at a high level. The discharging circuit Is' discharges the capacitance Ccomp to decrease the capacitance voltage. If the detection signal Scs is lower than the low reference level Vrl, the high compared result signal SH is at the low level and the low compared result signal SL is at the high level. Thus, the control signal S1 is at a high level and the control signal S2 is at a low level. The charging circuit Is charges the capacitance Ccomp to increase the capacitance voltage. If the detection signal Scs is lower than the high reference level Vrh and is higher than the low reference level Vrl, the high compared result signal SH and the low compared result signal SL both are at the low level. Therefore, the control signals S1 and S2 both are at the low level. The charging circuit Is and the discharging circuit Is' are respectively stopped charging and discharging the capacitance Ccomp to maintain the capacitance voltage.

When the dimming signal PWM represents that the LED module stops lighting, the second dimming signal Sd2 is at the low level. At this moment, no matter what the levels of the high compared result signal SH and the low compared result signal SL are, the control signal S1 and the control signal S2 both are at the low level. Hence, the capacitance voltage of the capacitance Ccomp is maintained.

Figure 6:
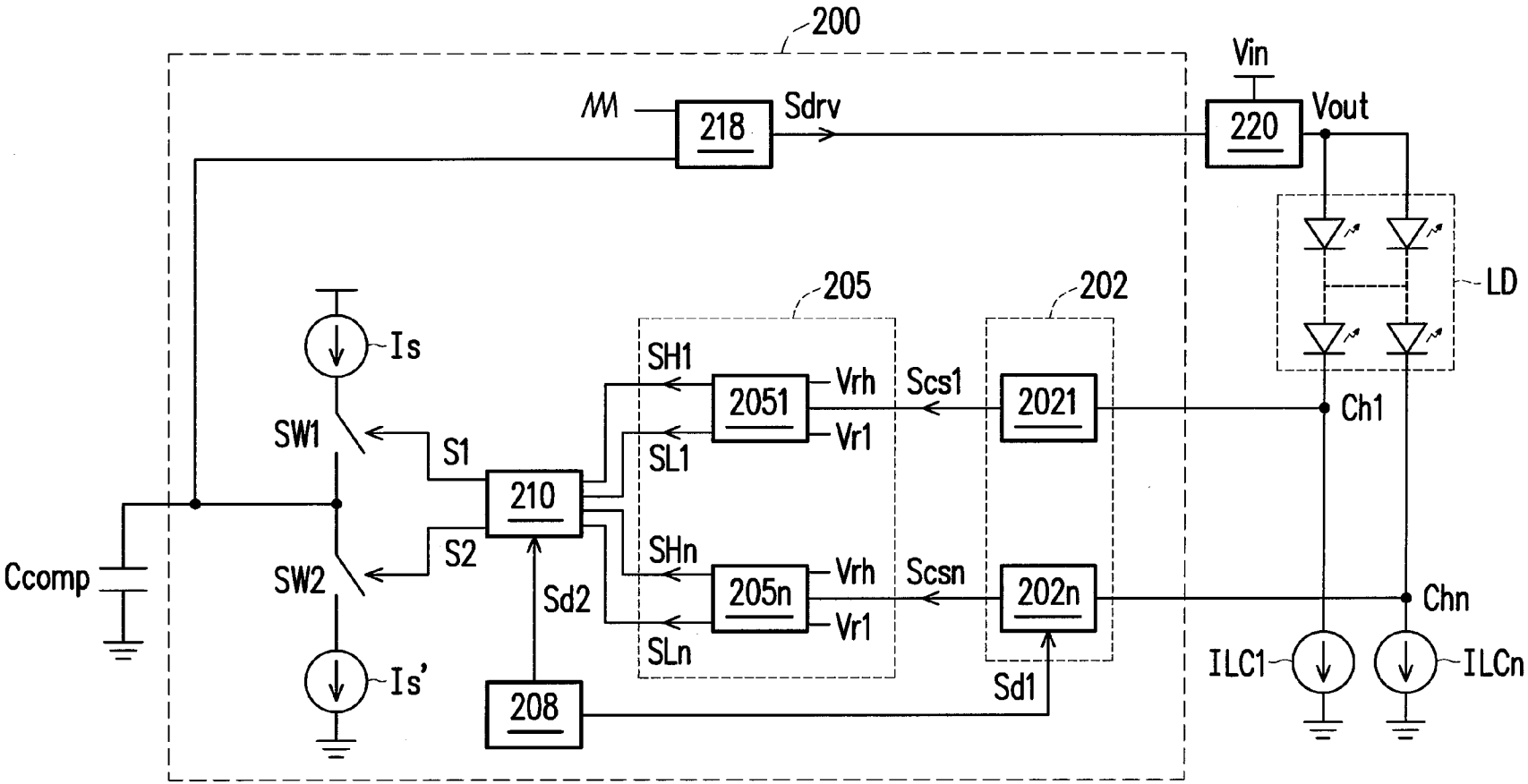
FIG. 6 is a schematic diagram of an LED driving circuit according to a second preferred embodiment of the present invention.

FIG. 6 is a schematic diagram of an LED driving circuit according to a second preferred embodiment of the present invention. The LED module LD of the present embodiment has a plural of LED strings. The plural of the current control circuits ILC1-ILCn respectively are coupled to corresponding one of a plural of the LED strings through the current control ends Ch1-Chn to control the current of the LED strings stabilizing at the predetermined current value. A detection circuit 202 of a feedback control circuit 200 has a plural of detection sub-circuits 2021-202*n*, respectively coupled to corresponding one of the current control ends Ch1-Chn for generating detection signals Scs1-Scsn according to the state of the corresponding LED string. A comparison circuit 205 has a plural of comparison sub-circuits 2051-205*n*, which receives the high reference level Vrh, the low reference level Vrl and the detection signal generated by the corresponding detection sub-circuit of the detection signals Scs1-Scsn. The plural of the comparison sub-circuits 2051-205*n* respectively generates high compared result signals SH1-SHn and low compared result signal SL1-SLn according to the compared results. A compared result logic circuit 210 receives the high compared result signals SH1-SHn and the low-compared result signals SL1-SLn.

Figure 7:
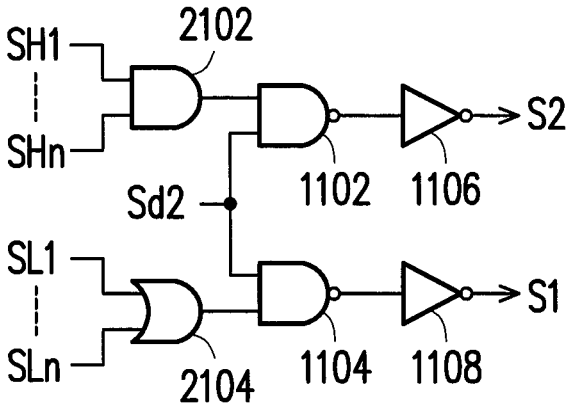
FIG. 7 is a schematic diagram of a compared result logic circuit according to a second preferred embodiment of the present invention.

FIG. 7 is a schematic diagram of a compared result logic circuit according to a second preferred embodiment of the present invention. The compared result logic circuit of the present embodiment additionally adds an AND gate 2102 and an OR gate 2104 on the basis of the compared result logic circuit shown in FIG. 5. When the dimming signal PWM represents that the LED module lights, the second dimming signal Sd2 is at the high level. When any one of the low compared result signals SL1-SLn is at the high level, i.e., any one of the detection signals Scs1-Scsn is lower than the low reference level Vrl, the OR gate 2104 outputs a high level signal to the NAND gate 1104. At this moment, the control signal S1 is at a high level and the control signal S2 is at a low level. The charging switch SW1 is turned on and the discharging switch SW2 is turned off. Therefore, the charging circuit Is charges the capacitance Ccomp to increase the capacitance voltage. When the high compared result signals SH1-SHn all are at the high level, i.e., the detection signals Scs1-Scsn all are higher than the high reference level Vrh, the AND gate 2102 outputs a high level signal to the NAND gate 1102. At this moment, the control signal S2 is at the high level and the control signal S1 is at the low level. The charging switch SW1 is turned off and the discharging switch SW2 is turned on, and so the discharging circuit Is' discharges the capacitance Ccomp to decrease the capacitance voltage. For the rest conditions, i.e., all detection signals Scs1-Scsn are higher than the low reference level Vrl, but not all of the above are higher than the high reference level Vrh, the control signal S1 and the control signal S2 are at the low level. At this moment, both the charging switch SW1 and the discharging switch SW2 are turned off, and the capacitance voltage of the capacitance Ccomp is maintained.

When the dimming signal PWM represents that the LED module stops lighting, the second dimming signal Sd2 is at the low level. At this moment, whether what the levels of the high compared result signals SH1-SHn and the low compared result signals SL1-SLn are, the control signal S1 and the control signal S2 both are at the low level. Thus, the capacitance voltage of the capacitance Ccomp is maintained.

Referring to FIG. 6, a PWM control circuit 218 receives the ramp signal and the capacitance voltage of the capacitance Ccomp and accordingly generates the control signal Sdrv to control a converting circuit 220 for adjusting the output voltage Vout.

Figure 8:
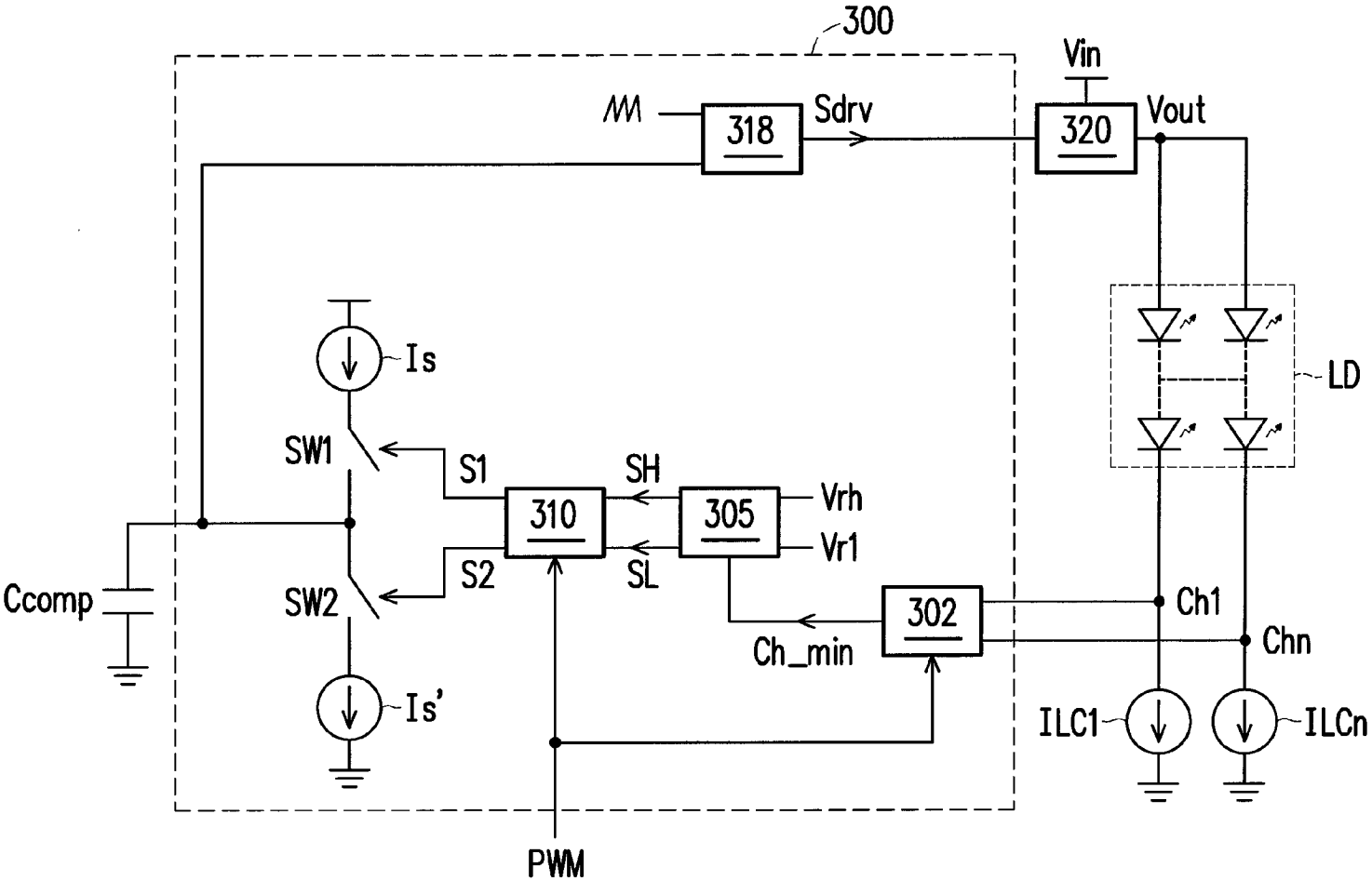
FIG. 8 is a schematic diagram of an LED driving circuit according to a third preferred embodiment of the present invention.

FIG. 8 is a schematic diagram of an LED driving circuit according to a third preferred embodiment of the present invention. The present embodiment replaces the detection circuit with a minimum voltage detection circuit 302. The minimum detection circuit 302 is coupled to the current control ends Ch1-Chn and compares the voltages of the current control ends Ch1-Chn with each other, and accordingly outputs a minimum voltage signal Ch_min according to the minimum voltage among the voltages of the current control ends Ch1-Chn. A comparison circuit 305 receives the low reference level Vrl, the high reference level Vrh and the minimum voltage signal Ch_min. When the minimum voltage signal Ch_min is higher than the high reference level Vrh, the comparison circuit 305 outputs the high compared result signal SH with high level and the low compared result signal SL with low level. At this moment, a compared result logic circuit 310 outputs the control signal S2 with high level and the control signal S1 with low level to turn on the discharging switch SW2 and turn off the charging switch SW1. Thus, the discharging circuit Is' discharges the capacitance Ccomp for reducing the capacitance voltage. When the minimum voltage signal Ch_min is lower than the low reference level Vrl, the comparison circuit 305 outputs the high compared signal SH with low level and the low compared result signal SL with high level. At this moment, the compared result logic circuit 310 outputs the control signal S2 with low level and the control signal S1 with high level to turn on the charging switch SW1 and turn off the discharging switch SW2. Thus, the charging circuit Is charges the capacitance Ccomp for increasing the capacitance voltage. When the minimum voltage signal Ch_min is lower than the high reference level Vrh and is higher than the low reference level Vrl, the comparison circuit 305 outputs the high compared result signal SH and the low-compared result signal SL both with low level. At this moment, the compared result logic circuit 310 outputs the control signals S1 and S2 both with low level to turn off the charging switch SW1 and discharging switch SW2. Hence, the capacitance voltage of the capacitance Ccomp is maintained.

In addition, the dimming control circuits 108 and 208 in the above embodiments generate the first dimming signal Sd1 and the second dimming signal Sd2 according to the dimming signal PWM. It may have a phase difference or a delay time between the first dimming signal Sd1 and the second dimming signal Sd2 to control the circuits which respond to the dimming signal PWM in a sequence. According to the practical application, the dimming control circuit 108 and 208 may be omitted. In a feedback control circuit 300 of the present embodiment, the dimming control circuit is omitted, and so the minimum voltage detection circuit 302 and the compared result logic circuit 310 directly receives the dimming signal PWM. Hence, the minimum voltage detection circuit 302 operates between sampling state and non-sampling state in response to the dimming signal PWM. The PWM control circuit 318 receives the ramp signal and the capacitance voltage of the capacitance Ccomp and accordingly generates the control signal Sdrv to control a converting circuit 320 for adjusting the output voltage Vout.

The feedback control circuit of the present invention executes changing, discharging and maintaining for the capacitance Ccomp through the above control loop to make the output voltage Vout not be modulated according to only a compared result of a reference level and the feedback signal. Therefore, the output voltage Vout is dynamically switched between being modulated and being maintained at a very low frequency. The feedback control circuit replaces the conventional error amplifier with the digital logic circuit.

Furthermore, the feedback control circuit of the present invention adds the controlling of the dimming signal PWM to the LED driving circuit. Under the control of a duty cycle of the dimming signal PWM lower than 100%, the feedback control circuit is switched between the sampling and the non-sampling states. Namely, when the dimming signal PWM represents that the LED module lihgts, the voltage of the capacitance Ccomp is adjusted normally according to the sampled result. On the other hand, when the dimming signal PWM represents that the LED module stops lighting, the voltage of the capacitance Ccomp is maintained. Thus, the LED driving circuit of the present invention is suitable to applications, such as the backlight of the LCD monitor, the illumination.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. A feedback control circuit, adapted to control a converting circuit to execute a power transformation for driving an LED module, wherein the LED module has at least one LED string connected in parallel, the feedback control circuit comprising:

a detection circuit, coupled to the LED strings of the LED module, and generating at least one detection signal in response to a state of the least one LED string;

a PWM circuit, comprising a capacitance, a charging circuit and a discharging circuit, wherein the charging circuit and the discharging circuit determines a capacitance voltage of the capacitance to increase, decrease or maintain according to a set of control signals;

a PWM logic control circuit, executing a logical operation on a dimming signal and compared results of a level of the at least one detection signal with a high reference level and a low reference level, and generating the set of the control signals in response to the logical operation, wherein the high reference level is higher than the low reference level; and a PWM control circuit, controlling the converting circuit to execute the power transformation in response to the capacitance voltage of the capacitance, wherein the PWM circuit determines the capacitance voltage of the capacitance to increase, decrease or maintain according to the set of the control signals when the dimming signal represents that the LED module lights.

2. The feedback control circuit according to claim 1, wherein the PWM circuit maintains the capacitance voltage of the capacitance when the dimming signal represents that the LED module stops lighting.

3. The feedback control circuit according to claim 2, further comprising a plural of the current control circuits each of which has a current control end coupled to a corresponding LED string of the LED strings for flowing through the corresponding LED string a predetermined current value.

4. The feedback control circuit according to claim 3, wherein the PWM logic control circuit increases the capacitance voltage when a level of any one of the least one detection signal is lower than the low reference level, decreases the capacitance voltage when the level of all of the least one detection signal is higher than the high reference level, and maintains the capacitance voltage in other situations.

5. The feedback control circuit according to claim 1, further comprising a plural of the current control circuits, each of which has a current control end coupled to a corresponding LED string of the LED strings for flowing through the corresponding LED string a predetermined current value.

6. The feedback control circuit according to claim 5, wherein the PWM logic control circuit increases the capacitance voltage when a level of any one of the least one detection signal is lower than the low reference level, decreases the capacitance voltage when the level of all of the least one detection signal is higher than the high level, and maintains the capacitance voltage in other situations.

7. An LED driving circuit, adapted to drive a plural of LED strings which are connected in parallel, comprising:

a converting, configured to execute the power transformation for driving the plural of LED strings;

a plural of current control circuits, each of which has a current control end coupled to a corresponding LED string of the plural of the LED strings for flowing through the corresponding LED string a predetermined current value; and a feedback control circuit, comprising:

a minimum voltage detection circuit, coupled to the current control ends, and generating a detection signal according to a minimum voltage among the current control ends;

a PWM circuit, comprising a capacitance, a charging circuit and a discharging circuit, wherein the charging circuit and the discharging circuit determines a capacitance voltage of the capacitance to increase, decrease or maintain according to a set of control signals;

a PWM logic control circuit, executing a logical operation on a dimming signal and compared results of a level of the at least one detection signal with a high reference level and a low reference level, and generating the set of the control signals in response to the logical operation, wherein the high reference level is higher than the low reference level; and a PWM control circuit, controlling the converting circuit to execute the power transformation in response to the capacitance voltage of the capacitance.

8. The LED driving circuit according to claim 7, wherein the PWM logic control circuit increases the capacitance voltage when the level of the detection signal is lower than the low reference level, decreases the capacitance voltage when the level of the detection signal is higher than the high reference level, and maintains the capacitance voltage when the level of the detection signal is between the high reference level and the low reference level.

9. The LED driving circuit according to claim 8, wherein the PWM circuit determines the capacitance voltage of the capacitance to increase, decrease or maintain according to the set of the control signals when a dimming signal represents that a plural of the LED strings lights, and maintains the capacitance voltage of the capacitance when the dimming signal represents that a plural of the LED strings stops lighting.

10. The LED driving circuit according to claim 7, wherein the PWM circuit determines the capacitance voltage of the capacitance to increase, decrease or maintain according to the set of the control signals when a dimming signal represents that a plural of the LED strings lights, and maintains the capacitance voltage of the capacitance when the dimming signal represents that a plural of the LED strings stops lighting.

* * * * *